US009556596B2

(12) United States Patent
Abbing

(10) Patent No.: US 9,556,596 B2
(45) Date of Patent: Jan. 31, 2017

(54) TAP LIQUID SAVINGS IN A LIQUID DISTRIBUTION SYSTEM

(75) Inventor: Erik Abbing, Luleä (SE)

(73) Assignee: 3eflow AB, Lulea (SE)

( * ) Notice: Subject to any disclaimer, the term of this patent is extended or adjusted under 35 U.S.C. 154(b) by 0 days.

(21) Appl. No.: 13/504,809

(22) PCT Filed: Oct. 28, 2010

(86) PCT No.: PCT/SE2010/051172

§ 371 (c)(1),
(2), (4) Date: Apr. 27, 2012

(87) PCT Pub. No.: WO2011/053237

PCT Pub. Date: May 5, 2011

(65) Prior Publication Data

US 2012/0211085 A1 Aug. 23, 2012

(30) Foreign Application Priority Data

Oct. 30, 2009 (SE) ..... 0950809

(51) Int. Cl.
*E03B 1/00* (2006.01)
*E03B 7/04* (2006.01)
*F24D 17/00* (2006.01)

(52) U.S. Cl.
CPC ..... *E03B 7/04* (2013.01); *E03B 7/045* (2013.01); *F24D 17/0078* (2013.01);
(Continued)

(58) Field of Classification Search
CPC ..... B08B 9/0323; B08B 9/0328; B67D 1/07; E03B 7/04; E03B 7/045; F24D 17/00; F24D 17/0078; F24D 17/0005; F24D 17/001; F24D 17/0031; F24D 17/0073; F24D 19/10;F24D 19/1006; F24D 19/1051; E03C 1/057; Y10T 137/0318; Y10T 137/3121; Y10T 137/3115; Y10T 137/3124; Y10T 137/6416; Y10T 137/85954; Y10T 137/85978; Y10T 137/7758; Y10T 137/7722; Y10T 137/0419
(Continued)

(56) References Cited

U.S. PATENT DOCUMENTS 2,039,006 A * 4/1936 Jasper ..... 137/207.5
2,178,559 A * 11/1939 Coben et al. ..... 137/207.5
(Continued)

FOREIGN PATENT DOCUMENTS

AU WO2007090238 8/2007
DE 4406150 A1 9/1995

OTHER PUBLICATIONS

Translation of DE 4406150, Ulrich Pumpe et al., Method for Energy and Water Saving in Hot Water Supply, 1995; translated Jun. 2014.*
(Continued)

*Primary Examiner* — William McCalister
*Assistant Examiner* — Ian Paquette
(74) *Attorney, Agent, or Firm* — Banner & Witcoff, Ltd.

(57) ABSTRACT

A liquid distribution system having at least one liquid conduit extending from a liquid source to a liquid tap and a method for substantially retaining the temperature of a liquid in the liquid distribution system. When a tapping operation is finished, the liquid is evacuated from the liquid conduit, and a gas is brought into the liquid conduit in order to replace the liquid therein and cause the liquid to flow backwards to the liquid source. When liquid is to be tapped from the liquid tap, the gas is evacuated from the liquid conduit.

20 Claims, 2 Drawing Sheets

(52) U.S. Cl.
CPC ..... *F24D 17/0031* (2013.01); *F24D 17/0073* (2013.01); *Y10T 137/0318* (2015.04); *Y10T 137/0419* (2015.04); *Y10T 137/3115* (2015.04); *Y10T 137/3121* (2015.04); *Y10T 137/3124* (2015.04); *Y10T 137/6416* (2015.04); *Y10T 137/7722* (2015.04); *Y10T 137/7758* (2015.04); *Y10T 137/85954* (2015.04)

(58) Field of Classification Search
USPC ..... 137/1, 15.04, 206, 207.5, 208, 455, 485, 137/486, 563, 565.01; 222/318, 424, 109; 4/DIG. 6
See application file for complete search history.

(56) References Cited

U.S. PATENT DOCUMENTS

| | | | | |
|---|---|---|---|---|
| 2,189,448 | A * | 2/1940 | McCrory | 137/207.5 |
| 5,794,643 | A | 8/1998 | Brice | |
| 5,803,111 | A * | 9/1998 | Soszka | 137/207.5 |
| 5,868,311 | A * | 2/1999 | Cretu-Petra | 236/12.12 |
| 5,944,221 | A | 8/1999 | Laing et al. | |
| 2005/0001046 | A1 | 1/2005 | Laing | |
| 2009/0145490 | A1 * | 6/2009 | Kershisnik | 137/334 |

OTHER PUBLICATIONS

International Search Report for PCT Application No. PCT/SE2010/051172, 4 sheets, dated Jan. 25, 2011.

* cited by examiner

TAP LIQUID SAVINGS IN A LIQUID DISTRIBUTION SYSTEM

This application is a national stage application of co-pending PCT application PCT/SE2010/051172 filed Oct. 28, 2010. The disclosure of this application is expressly incorporated herein by reference in its entirety.

FIELD OF THE INVENTION

The present invention relates to a method for substantially retaining the temperature of a liquid in a liquid distribution system having at least one liquid conduit extending from a liquid source to a liquid tap. The invention also concerns such a liquid distribution system, e.g. for distribution of hot and/or cold water in buildings, ships, aircraft, vehicles or other structures where a liquid is being distributed to one or more liquid taps.

BACKGROUND OF THE INVENTION AND PRIOR ART

In most buildings, there is a distribution system for water, normally with separate piping for cold and hot water. Often, water is provided from a public facility. For cold water, the water is lead directly from the source, possibly after reducing the pressure, and for the hot water, there is typically a local heater or a heat exchanger, so that cold and hot water can be tapped at various locations within the building.

From the source, the conduits are often quite long, so that fresh, relatively cold water will be obtained only after tapping quite a large volume of water that has been left in the conduits when water was tapped previously, maybe several hours or even days beforehand.

A similar problem is present for hot water, which will be cooled off when there is no longer any flow of hot water in the piping system from the heating source to the respective tap. In a prior art system, as disclosed in U.S. Pat. No. 5,944,221 (Laing), there is provided a re-circulation assembly. The cooled-down (previously hot) water in the hot water line is re-circulated by a pump back to the hot water tank, where it is reheated before being delivered again. Hereby, the heat energy contained in the hot water will be fed back to the hot water tank. However, this requires a special re-circulation piping system, which is generally rather costly to install and maintain. Because of the risk of growth of micro-organisms in a hot water line, it is not permitted to re-circulate the cooled-down water through the piping intended for cold and fresh water.

OBJECT OF THE INVENTION

Against this background, the object of the present invention is to provide a more economical method and system for saving liquid, without the need for double piping for each line extending from a liquid source to a liquid tap. A further object is to save energy by capturing the heat contained in the hot water in the hot water line before it is lost by being transferred to the surrounding structure or the ambient air.

SUMMARY OF THE INVENTION

The stated object is achieved by a method according the invention, comprising the steps of evacuating the liquid from the liquid conduit when a tapping operation is finished, by generating a backward pressure gradient in said liquid conduit, causing the liquid to flow backwards toward the liquid source, while letting a gas flow into the liquid conduit and replace the backwardly flowing liquid therein, stopping the backward flow of liquid when the liquid conduit is evacuated and evacuating the gas from the liquid conduit when liquid is tapped from said liquid tap, by generating a forward pressure gradient in the liquid conduit, causing the liquid to flow from the liquid source to the liquid tap.

Preferably, the liquid is evacuated from the liquid conduit by applying an under-pressure in said liquid conduit at a position located at a distance from said liquid tap, adjacent to said liquid source, and bringing an air-valve, located in the vicinity of said liquid tap, to open so as to permit ambient air to be sucked into said liquid conduit and to replace the liquid therein. If and when there is a need for tapping liquid from said liquid tap again, a pressure may be applied in said liquid conduit so as to bring about a flow of liquid into said liquid conduit towards said liquid tap.

The air-valve should be closed at the latest, when the liquid reaches said air-valve, so that the liquid will flow out only through said liquid tap and not through said air valve.

In this way, it is sufficient to provide a single pipe line or conduit from said source to said tap, making the piping system simpler and less expensive. Also, the flow of liquid from said source to said tap, upon opening the tap again after some time, will be much faster, since the air or gas contained in the liquid conduit, can be blown out much faster than any liquid through the same conduit. In case the liquid is water, it is estimated that the elapsed time will be about three to ten times less when air is evacuated and a new volume of water is being filled into the conduit.

Water or liquid will be saved since there is no longer any need to let a volume of liquid flow out of the tap before using the liquid. For cooled or heated liquid, in particular water, there will also be an energy saving.

A liquid distribution system, according to the invention, comprises:

a pressure controlling device for generating a backward pressure gradient in said liquid conduit causing, when a tapping operation is finished, the liquid to flow backwards towards said liquid source, and a valve device adapted to let in gas to replace said liquid in said liquid conduit.

Preferably, the pressure controlling device is adapted to generate an under-pressure in the liquid conduit at a position located at a distance from said liquid tap, adjacent to the liquid source, when there is no flow of liquid in said water conduit towards said liquid tap. Furthermore, the valve device may comprise an air-valve, located in the vicinity of said liquid tap, for sucking in ambient air into said liquid conduit.

The pressure controlling device is preferably adapted to apply a pressure in said liquid conduit, when there is a need for tapping liquid from said liquid tap again, so that liquid will flow into said liquid conduit towards said liquid tap.

Of course, other liquids than water can be distributed in the system, such as beverages, liquids for cleaning purposes or for other industrial applications, or any other liquids.

Preferred embodiments of the method and the system according to the invention are defined in the dependent claims and will appear from the detailed description below.

BRIEF DESCRIPTION OF THE DRAWINGS

The invention will now be explained in more detail below, with reference to some exemplary embodiments illustrated in the drawings.

DETAILED DESCRIPTION OF PREFERRED EMBODIMENTS OF THE INVENTION

Figure 1:
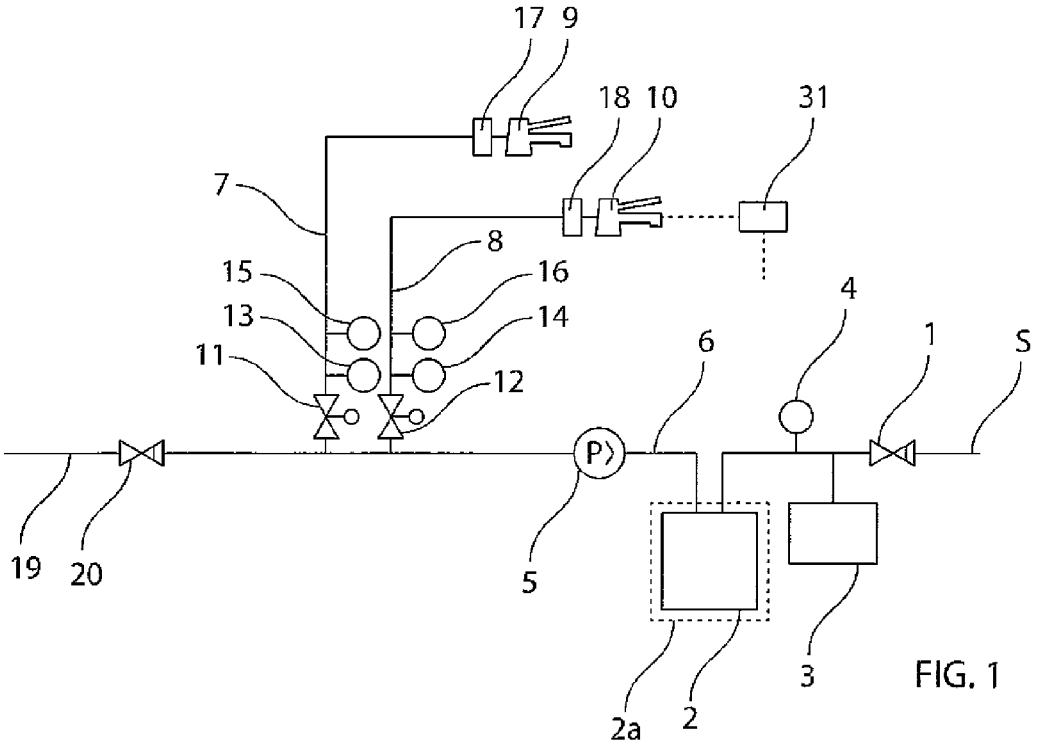
FIG. 1 shows, in a schematic diagram, a hot water distribution system according to the invention, with two separate conduits for hot water, and a hot water tank.

In the water distribution system shown in FIG. 1, water is provided from a source S of fresh water, e.g. a public water supply line or a local water supply, via a non-return valve 1 (to the right in FIG. 1) to a hot water tank 2, where the water is heated, e.g. by an electric heating element, a heat pump, or a gas burner, to a relatively high temperature, typically in the interval 60-90° C. The tank is insulated all around, as indicated schematically by the dashed contour 2*a*, so as to minimize the inevitable heat loss.

Between the water source S and the hot water tank 2, there is a hydro-pressure vessel 3, containing a variable volume of air or gas, e.g. nitrogen, and a pressure sensor 4, possibly connected to a pressure regulating device (not shown).

At the outlet side of the hot water tank 2, there is a pump 5 in a hot water feeding line 6 which in turn is connected to two parallel hot water conduits 7, 8. In this simplified example there are two such conduits. It is understood, however, that there are typically a number of such conduits leading to various parts of a building. At the end of each such hot water conduit, there is a hot water tapping device 9, 10. As is well known in the art, the tapping devices can be connected to a cold water line (not shown) as well and be equipped with a mixing unit in order to provide tapping water of a desired temperature. Such devices can be manually or automatically operated.

In each hot water conduit 7, 8, adjacent to the respective connection to the hot water feed line 6, there is a control valve 11, 12, which can be opened or closed, a level sensor 13, 14 and a pressure sensor 15, 16. As is shown in FIGS. 1-4, the level sensor 13, 14 and the pressure sensor 15, 16 are each located proximate (e.g., adjacent to) not just the hot water feed line 6 adjacent control valve 11, 12 but the control valve 11, 12 itself. As is further shown in FIGS. 1-4, relative to each hot water conduit 7, 8, the level sensor 13, 14 and the pressure sensor 15, 16 are each not just proximate to the control valve 11, 12 but they are distally located from the hot water tapping device 9, 10. Moreover, in the vicinity of each tapping device 9, 10, there is provided an air-valve 17, 18, the function of which will be explained below.

In the system shown in FIG. 1, there is also a further, typically rather short hot water conduit 19, which can be closed off by means of a valve 20. This conduit 19 has no direct relation to the present invention.

The distribution system shown in FIG. 1 operates as follows: Hot water, under a moderate pressure controlled by the pressure sensor 4 and the hydro-pressure vessel 3, can be tapped from either one of the tapping devices 9, 10 from the hot water tank 2 via one of the hot water conduits 7 and 8, the associated control valve 11 or 12 being open at this time. When the hot water tapping device 9 or 10 is closed (assuming that the other one is also closed), manually or by remote control, the corresponding pressure sensor 15 or 16 will react on the consequential pressure increase, whereupon the pump 5 will be activated. Similarly the pump 5 will be activated if there is no flow of water being sensed by the pressure or flow sensor 4.

The pump 5 will only be activated in case all other hot water conduits 7, 8 are passive, i.e. there is no forward flow of hot water in these other conduits. This may be checked automatically by a control unit associated with the distribution system or, alternatively, the evacuation of one or more hot water conduits can be initiated manually. Normally, the control unit of the distribution system will initiate the evacuation process in all hot water conduits 7, 8 shortly after all tapping devices 9, 10 have been closed.

Upon being activated, the pump 5 will cause a decrease of the pressure in the associated hot water conduit and a backward flow of hot water through the hot water feed line 6 to the hot water tank 2. The backward flow of water is made possible by way of the air-valve 17 or 18, which is opened (manually or automatically) so as to let in ambient air into the conduit 7 or 8.

Now, the pump 5 will be operated to evacuate the respective hot water conduit 7, 8 while at the same time letting the incoming air replace the hot water in the conduit. The hot water is pumped backwards through the hot water tank 2 and will push water into the hydro-pressure vessel 3, where the gas volume will be reduced and build up a higher pressure.

Normally, the water being pushed out of the hot water tank 2 is located at the bottom of the tank 2 and has a much lower temperature than the water at the top of the tank adjacent to the outlet to the hot water feed line 6.

The pump 5 will operate until the hot water conduit 7 or 8 is completely evacuated, which is sensed by the level sensor 13 or 14. When this happens, the associated valve 11 or 12 will be closed, and the pump 5 will be stopped when there is no flow of water either way in the feed line 6.

The air-valve 17, 18 may be adapted to open automatically in response to the generation of said under-pressure.

After evacuating all the hot water conduits 7, 8, the air-valves 17, 18 and the associated valves 11, 12 are closed again, leaving a slight under-pressure in these conduits 7, 8.

Assuming that all (both) hot water conduits 7, 8 are evacuated and filled with air at an under-pressure, the operation for tapping hot water can be effected in different ways:

A first way is to open one of the tapping devices 9,10, which will increase the pressure in the conduit 7,8 to atmospheric pressure. This pressure increase will be sensed by the pressure sensor 15, 16 and cause the associated valve 11, 12 to open and the hot water in the feed line 6 (at a pressure built up by the pump 5 in the preceding evacuating process) to flow against the ambient air pressure in the open air-valve 17 or 18, so that the conduit 7 or 8 will be filled again with hot water.

A second way is to let the movement sensor 31 react and open the air-valve 18, causing a pressure increase in the conduit 8 and a subsequent filling of hot water into this conduit.

A third way is to manually operate an actuator, such as a manual knob or switch which will open the air-valve 18, also causing a pressure increase in the conduit 8 and a filling of hot water into this conduit.

In the associated air-valve 17, 18 there is also a liquid floating sensor (not shown) which will cause the air-valve to close when the hot water reaches the air-valve. In this way, the hot water will flow out of the water tapping device 9 or 10 only, and not through the air-valve. Possibly, the opening of the tapping device 9,10 is effected as a separate step after filling the conduit 7,8 with hot water.

When the tapping device is operated to close again, the process described above will be repeated.

The water distribution system shown in FIG. 1 may be improved and modified in many ways.

The control valves 11, 12 may also be used for other purposes, in conjunction with the pressure sensor 15, 16.

A possible leakage in the liquid conduit 7, 8 or its associated components, can be detected by closing the control valve 11, 12 while there is still some liquid retained in the conduit. In case there is a leakage, the pressure will drop considerably, and this pressure drop is an indication of a leakage in the system. Of course, an alarm signal can be triggered, if desired.

Another possibility is to monitor whether the water is freezing in the conduits. If the valve 11, 12 is closed, and no water is being tapped through the tapping device 9, 10, there will be a pressure increase when the water freezes into ice, which can be detected by the pressure sensor 15, 16. Similarly, an alarm signal may be generated.

Figure 2:
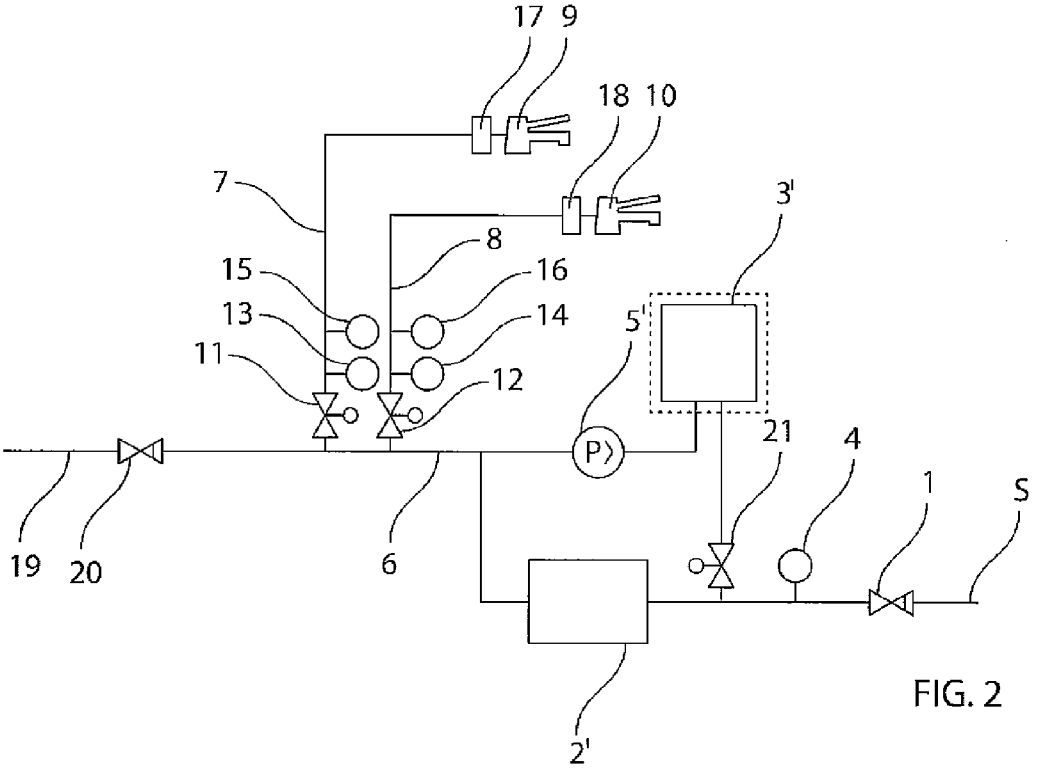
FIG. 2 shows a similar diagram of a system with a hydro-pressure vessel connected in parallel to a heat exchanger.
Figure 3:
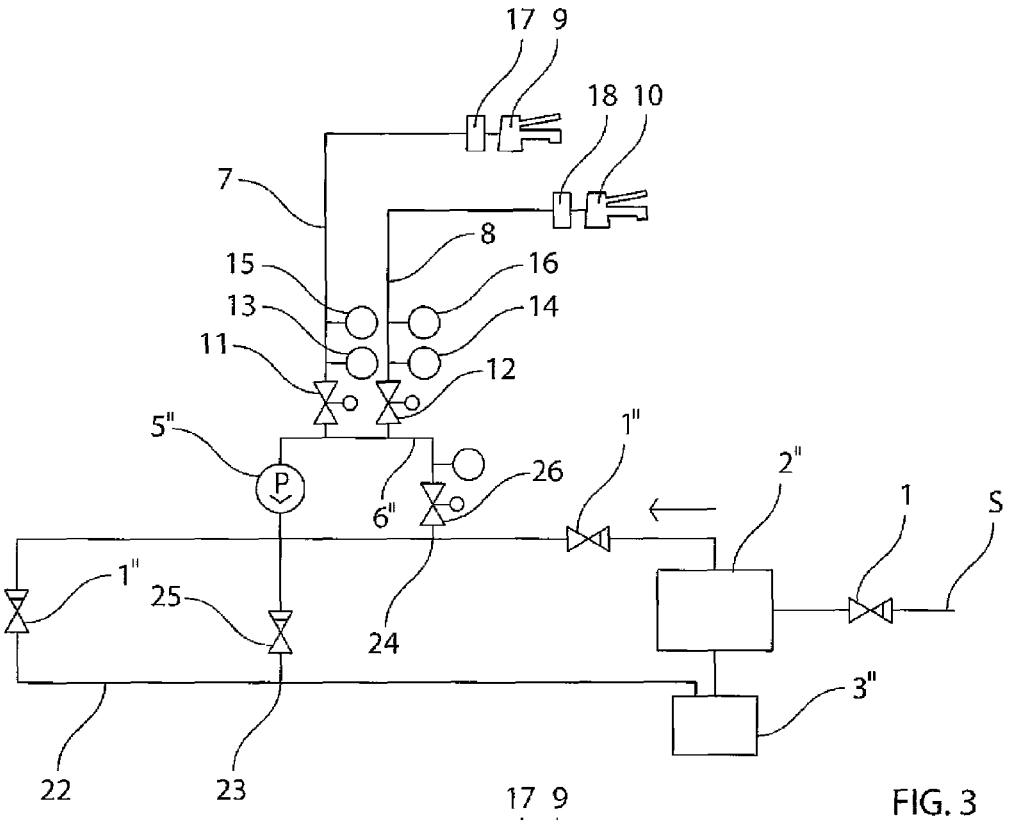
FIG. 3 shows, likewise in a schematic diagram, a system with a hot water circulating loop connected between a heat source and two individual hot water conduits.
Figure 4:
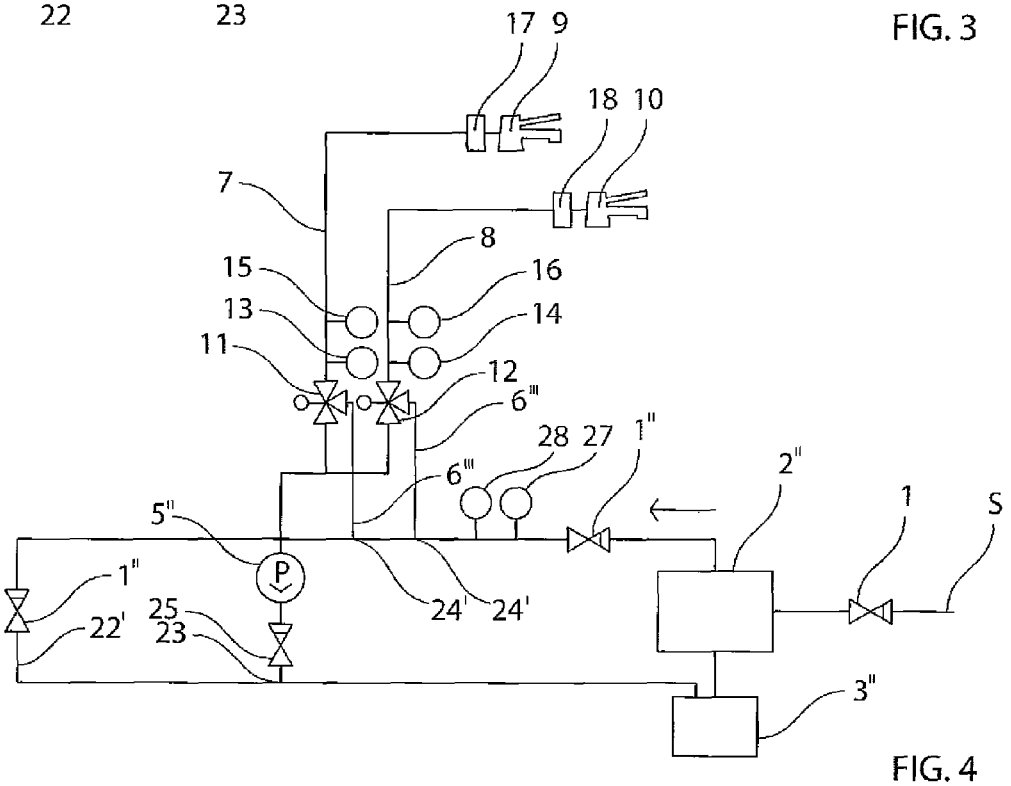
FIG. 4 shows a similar system as in FIG. 3, with many parallel hot water conduits.

In FIGS. 2, 3 and 4, corresponding components have the same reference numerals as in FIG. 1 and will not be described over again. These alternative embodiments are included to illustrate that the system and the method of the invention can be modified in many ways within the scope defined by the appended claims.

In the system of FIG. 2, the hot water conduits 7 and 8, and the components 9 through 18 (and also 19 and 20) may be designed to operate in the same way as in FIG. 1. However, instead of a hot water tank 2, there is a heat exchanger 2' inserted between the feed line 6 and the non-return valve 1. Also, the pump 5' is coupled in parallel with the heat exchanger 2' (rather than in series as in FIG. 1), and is connected on its pressure side to a heat insulated hydro-pressure vessel 3' which is also connected to the water supply line (with the non-return valve 1) via a control valve 21 which closes if and when the pressure in the vessel 3' falls below the feeding pressure sensed by the pressure sensor 4.

In the system of FIG. 2, the pump 5' will operate directly to increase the pressure in the variable gas volume in the hydro-pressure vessel 3', when the hot water in the respective hot water conduit is evacuated. When the hot water tapping device 9 or 10 is operated to open again, the somewhat elevated gas pressure contained therein will cause the hot water to flow in the forward direction and fill the hot water conduit, basically in the same way as in FIG. 1. When the hot water in the hydro-pressure vessel 3' is emptied, the valve 21 will be closed, and the water from the water source S will flow through the heat exchanger 2' to the hot water conduit associated with the open tapping device 9 or 10.

In FIG. 3, there is a re-circulating loop 22 of hot water passing through a water heater 2" (a tank or a heat exchanger) and a hydro-pressure vessel 3". The hot water is circulated by means of a circulation pump (not shown) adjacent to the heater 2", and two further non-return valves 1" will ensure that the circulation is maintained in one direction only.

The water heater 2" is connected to the water source S via the non-return valve 1, and the (single) hot water conduits 7, 8 are connected to the re-circulating loop 22 at two points 23, 24 via a non-return valve 25 and a control valve 26, respectively, so as to form between them a bridging hot water feed line 6" containing an evacuation pump 5". In this embodiment, the re-circulating loop 22 can be regarded as the heat source, since the circulating water is always kept at an elevated temperature, such as 60-90° C., and will continuously supply the hot water conduits 7, 8 with hot water. The loop 22 is preferably heat insulated to minimize the heat losses.

In the modified embodiment illustrated in FIG. 4, there are many liquid conduits 7, 8 although only two of them are drawn in the figure.

The distribution system is basically the same as in FIG. 3, although one of the non-return valves in the re-circulating loop 22' (serving as a heat source) is situated between the feed points 24' and the return part of the loop, and there are separate feed lines 6'" to the respective control valves 11, 12 of the hot water conduits 7, 8. The return ends of these control valves are connected jointly to a junction 23 at the recirculating loop 22'.

In large buildings, e.g. with many different apartments, there are typically a large number of water conduits 7, 8, each serving a particular apartment, individually or in groups.

There is also a temperature sensor 27 in the recirculating loop 22', and a flow sensor 28. The latter may be divided into one or a few sensors for each apartment, so that the hot water consumption for each apartment can be recorded. In such a case there will be typically 2 to 4 hot water lines 7, 8 to each apartment, each with a control valve 11, 12 and a common flow sensor 28 allocated to the particular apartment.

With the structure illustrated in FIG. 4, each line (liquid conduit 7, 8) can be operated independently of the other lines. So, the respective line can be fed with liquid, or be emptied independently.

The operation of the system shown in FIG. 4 is in principle the same as in the previous embodiments.

The liquid distribution system as described above, with reference to the four practical embodiments, can be modified in many ways within the scope of the appended claims.

The system does not need to be pressurised all the time. It is sufficient to pump water in the forward and backward directions, as necessary for the desired operation.

The air-valves 17,18 may be located at some (small) distance from the respective tapping device 9,10, e.g. inside an adjacent wall, cupboard or the like. Also, one air-valve can serve a small number of tapping devices located relatively close together, e.g. in a public toilet or rest room.

Likewise, the hot water or liquid conduits do not have to extend completely all the way from the heater or liquid source but can be connected at a distribution point located at some (rather small) distance from the heater (or heat exchanger or hot water circulating loop).

The piping in the hot water circulating loop 22 (FIG. 3) do not have to be provided with an extra heat insulation. In some kinds of buildings, there are heat insulated cavities within the building structure, and it is also possible to let the leaking heat be a part of the heating system of the building, especially in cold climates.

Especially in hot and tropic climates, on the other hand, the liquid circulation system will be primarily designed to keep the tap water cool (e.g. 15-20° C. rather than 30-40° C.). It is understood that the same principles can be applied. If necessary, the heater can then be replaced by a cooling or refrigeration unit.

Additionally, there may be provided a flow sensor at the inlet of the heater (or cooling unit) so that the control unit will know whether water has been tapped somewhere in the system during a preceding time period, such as 60 s. This information can be used to activate the actuation of the various liquid conduits.

The device for creating an under-pressure during evacuation of the liquid conduits has been described as a pump.

Alternatively, some other device maybe foreseen, such as a piston-cylinder device or an expandable container creating an under-pressure when being expanded. Alternatively, the pressure gradient may be generated by applying a higher gas or air pressure (over-pressure) adjacent to the liquid tap.

The hydro-pressure vessel 3 (or 3', 3") may operate against atmospheric pressure and function as a lung. The essential feature is that the vessel should accommodate a variable volume of air or gas.

The floating device in the air-valve 17, 18 may be replaced by some other actuator which closes the air-valve in the presence of liquid.

The method and system according to the invention has a number of advantages: In the first place, water is saved. The water remaining in the individual single liquid conduits will be brought back to the source of liquid, e.g. a heater, and can be used later on.

Energy is saved, both in the case of hot water tapping water and cold water tapping water. The volume of water contained in the single liquid conduits will keep its temperature and can be re-used. Thus, thermal losses will be avoided.

The growth of micro-organisms in hot water piping will be avoided, since the temperature will always be high in the hot water, and the replacing air will not stimulate such growth.

As indicated above, although the method and distribution system according to the invention is applicable to various kinds of liquids, the primary application is that the liquid is water.

The invention claimed is:

1. A method for substantially retaining a temperature of a liquid in a liquid distribution system having a liquid source, a liquid feed line fluidly coupled to the liquid source, a liquid distribution conduit extending from a first end next to said liquid feed line to a second end at a liquid tap, and a feed control valve located at said first end between the liquid feed line and the liquid distribution conduit comprising the steps of:

evacuating the liquid from the liquid distribution conduit when a tapping operation is finished, by generating a backward pressure gradient in the liquid distribution conduit, causing the liquid to flow backwards from said second end towards said first end and the liquid feed line, while letting a gas flow into the liquid distribution conduit and replace the backwardly flowing liquid therein, stopping the backward flow of liquid when the liquid distribution conduit is evacuated, and evacuating the gas from the liquid distribution conduit when liquid is to be tapped from the liquid tap, by generating a forward pressure gradient in the liquid distribution conduit causing the liquid to flow from said first end at said feed control valve via the liquid distribution conduit to the second end at said liquid tap, wherein the step of evacuating the liquid from the liquid distribution conduit is initiated by sensing, via a sensor, a physical variable in the liquid distribution conduit, at a location at said first end adjacent to said feed control valve, the physical variable being caused to change at said second end by an activation of said liquid tap and to propagate along the liquid distribution conduit back to said location at said first end adjacent to said feed control valve, and indicating whether or not there is a flow of the liquid in the liquid distribution conduit, and after sensing a change indicating that the flow of liquid has stopped, activating a pressure controlling device, to generate the backward pressure gradient in the liquid distribution conduit.

2. The method of claim 1, wherein the liquid distribution system includes a plurality of liquid distribution conduits extending from a corresponding feed control valve of a plurality of feed control valves to a corresponding liquid tap of a plurality of liquid taps, the method further comprising:

evacuating liquid from one liquid distribution conduit of the plurality of liquid distribution conduits, when a tapping operation corresponding to said one liquid distribution conduit is finished;

stopping backward flow of liquid when said one liquid distribution conduit is evacuated; and evacuating gas from said one liquid distribution conduit when liquid is to be tapped from a liquid tap corresponding to said one liquid distribution conduit, wherein the step of evacuating the liquid from said one liquid distribution conduit is initiated by sensing the physical variable in said one liquid distribution conduit, at a location adjacent to said corresponding feed control valve, the physical variable being caused to change by an activation of the liquid tap corresponding to said one liquid distribution conduit and to propagate along said one liquid distribution conduit back to said location adjacent to said corresponding feed control valve, and indicating whether or not there is a flow of liquid in said one liquid distribution conduit, and after sensing a change indicating that the flow of liquid has stopped in said one liquid distribution conduit, activating the pressure controlling device, to generate the backward pressure gradient in said one liquid distribution conduit.

3. The method as claimed in claim 1, wherein the step of evacuating the liquid from the liquid distribution conduit is accomplished by causing the pressure controlling device to apply an under-pressure in the liquid distribution conduit at a position located at a distance from the liquid tap, adjacent to said feed control valve, and bringing a gas-valve to open so as to permit the gas to be sucked into the liquid distribution conduit and to replace the liquid therein, wherein the gas-valve is more proximate to the liquid tap than the sensor is to the liquid tap.

4. The method as claimed in claim 3, wherein when evacuating the gas from the liquid distribution conduit when liquid is to be tapped from the liquid tap, the gas-valve is brought to close at the latest, when liquid is being tapped again through the liquid tap.

5. The method as claimed in claim 4, wherein when liquid is to be tapped again through said liquid tap, the gas-valve is brought to fully evacuate the liquid distribution conduit from gas before any liquid is tapped through the liquid tap.

6. A liquid distribution system for substantially retaining a temperature of a liquid being distributed and having a liquid source, a liquid feed line with a feed control valve fluidly coupled to the liquid source, and at least one liquid distribution conduit extending from a first end at said feed control valve to a second end at a liquid tap, characterized in that the system comprises:

the liquid feed line fluidly coupled to said liquid source, said feed control valve located at said first end between the liquid feed line and the at least one liquid distribution conduit, at least one sensor for sensing a physical variable indicating whether or not there is a flow of liquid in the at least one liquid distribution conduit, said at least one sensor being located at said first end of said liquid distribution conduit adjacent to said feed control valve, and being adapted to sense a change of said physical variable occurring at said second end at said liquid distribution conduit, as a consequence of said liquid tap being activated, said change propagating back from said liquid tap at said second end along said liquid distribution conduit to said at least one sensor located at said first end adjacent to said feed control valve, and a pressure controlling device being activated by said at least one sensor for generating a backward pressure gradient in the at least one liquid distribution conduit causing, when a tapping operation is finished, the liquid to flow backwards towards said first end and said feed control valve.

7. The liquid distribution system as claimed in claim 6, wherein said pressure controlling device is adapted to generate an under-pressure in the at least one liquid distribution conduit at a position located at said first end at a distance from the liquid tap adjacent to said feed control valve.

8. The liquid distribution system as claimed in claim 6, wherein said at least one sensor is a liquid pressure sensor for sensing a pressure change appearing when the liquid tap is opened, said liquid pressure sensor being adapted to activate said pressure controlling device to apply pressure in said at least one liquid distribution conduit.

9. The liquid distribution system as claimed in claim 6, wherein said liquid source is a closed loop for circulating hot water through a heating device, and feeding a number of hot water distribution conduits.

10. The liquid distribution system as claimed in claim 6, wherein the pressure controlling device includes a valve and a pump adapted to pump liquid backwards towards a compressible volume of nitrogen gas.

11. The liquid distribution system of claim 6, wherein:

the liquid tap is one of a plurality of liquid taps;

the at least one liquid distribution conduit is one of a plurality of liquid distribution conduits extending from the liquid feed line to the plurality of liquid taps;

the feed control valve is one of a plurality of feed control valves located between the liquid feed line and a corresponding liquid distribution conduit of the plurality of liquid distribution conduits; and the at least one sensor is one of a plurality of sensors located adjacent the liquid feed line and adapted to sense the physical variable in the corresponding liquid distribution conduit of the plurality of liquid distribution conduits.

12. The liquid distribution system as claimed in claim 6, wherein said pressure controlling device includes a valve and a pump adapted to pump liquid backwards towards a compressible volume of gas.

13. The liquid distribution system as claimed in claim 12, wherein said liquid source is one of a water storage vessel and a heat exchanger communicating with said compressible volume of gas.

14. The liquid distribution system as claimed in claim 12, wherein said liquid source is a hot water tank.

15. The liquid distribution system as claimed in claim 6, further comprising a gas-valve for sucking in gas into the at least one liquid distribution conduit, wherein the gas-valve is more proximate to the liquid tap than the sensor is to the liquid tap.

16. The liquid distribution system as claimed in claim 15, wherein said pressure controlling device is adapted to apply a pressure in the at least one liquid distribution conduit, when there is a need for tapping liquid from the liquid tap again, so that liquid will flow into the at least one liquid distribution conduit towards the liquid tap.

17. The liquid distribution system as claimed in claim 16, wherein the system further comprises a liquid detection device located in a vicinity of said gas-valve for detecting that the forward flowing liquid has reached a vicinity of the liquid tap and thereupon causing the gas-valve to close and to open a passage to the liquid tap.

18. The liquid distribution system as claimed in claim 16, further comprising a movement detector being adapted to activate said pressure controlling device, so as to apply pressure in said at least one liquid distribution conduit and to close said gas-valve.

19. The liquid distribution system as claimed in claim 16, further comprising a movement detector being adapted to activate the pressure controlling device, so as to apply pressure in the at least one liquid distribution conduit and to close the gas-valve upon detecting that the forward flowing liquid has reached a vicinity of the liquid tap.

20. A liquid distribution system fluidly coupling a liquid source to a plurality of liquid taps, comprising:

a liquid feed line fluidly coupled to the liquid source;

a plurality of liquid distribution conduits, each liquid distribution conduit extending from a respective first end next to the liquid feed line to a respective second end at a respective liquid tap;

a plurality of feed control valves, each feed control valve located its respective first end between the liquid feed line and a respective liquid distribution conduit; and a plurality of sensors, each sensor being associated with a respective liquid distribution conduit and being located at its respective first end adjacent its respective feed control valve, wherein each said sensor is configured to, in response to finishing of a corresponding tapping operation at its respective liquid tap, activate a device configured to generate a pressure that causes liquid in its respective liquid distribution conduit to flow from its respective second end at its respective liquid tap to its respective first end adjacent its respective feed control valve; and wherein the liquid distribution system is configured to, in response to an activation of a liquid tap, cause liquid to move from the liquid feed line to its respective first end at its respective liquid tap and via its respective feed control valve and its respective liquid distribution conduit.

* * * * *